US012247312B2

(12) United States Patent
Tajiri et al.

(10) Patent No.: US 12,247,312 B2
(45) **Date of Patent: *Mar. 11, 2025**

(54) MANDREL FOR ELECTROFORMING

(71) Applicant: Unison Industries, LLC, Jacksonville, FL (US)

(72) Inventors: Gordon Tajiri, Waynesville, OH (US); Emily Marie Phelps, Bellbrook, OH (US); Dattu G V Jonnalagadda, Ponnur (IN); Joseph Richard Schmitt, Springfield, OH (US); Yanzhe Yang, Mason, OH (US)

(73) Assignee: Unison Industries, LLC, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/322,122

(22) Filed: May 23, 2023

(65) Prior Publication Data

US 2023/0295828 A1 Sep. 21, 2023

Related U.S. Application Data

(63) Continuation of application No. 16/015,345, filed on Jun. 22, 2018, now Pat. No. 11,686,012.

(60) Provisional application No. 62/577,409, filed on Oct. 26, 2017.

(51) Int. Cl.

| | |
|---|---|
| ***C25D 1/02*** | (2006.01) |
| ***C25D 1/00*** | (2006.01) |
| ***C25D 17/12*** | (2006.01) |
| ***C25D 21/02*** | (2006.01) |

(52) U.S. Cl.

CPC ..... *C25D 21/02* (2013.01); *C25D 1/00* (2013.01); *C25D 1/02* (2013.01); *C25D 17/12* (2013.01)

(58) Field of Classification Search

None

See application file for complete search history.

(56) References Cited

U.S. PATENT DOCUMENTS

| | | | | |
|---|---|---|---|---|
| 1,855,809 A | | 4/1932 | Sheppard et al. | |
| 2,844,529 A | * | 7/1958 | Cybriwsky | C25D 11/08 205/139 |
| 3,299,492 A | | 1/1967 | Sargent | |
| 4,098,652 A | | 7/1978 | Koenig | |
| 4,202,706 A | | 5/1980 | Newell et al. | |
| 4,428,801 A | | 1/1984 | Dugan | |

(Continued)

FOREIGN PATENT DOCUMENTS

| | | |
|---|---|---|
| CN | 101255578 A | 9/2008 |
| CN | 102828214 B | 1/2016 |

(Continued)

OTHER PUBLICATIONS

English translation CN 202067676 (Year: 2011).*
English translation WO 2008/091262 (Year: 2008).*

*Primary Examiner* — Stefanie S Wittenberg
(74) *Attorney, Agent, or Firm* — McGarry Bair PC

(57) ABSTRACT

An apparatus and method for a mandrel used during an electroforming process. The mandrel is formed of a structural wax and includes a metallic layer utilized to formulate a metal component. During the electroforming process, the mandrel is actively cooled utilizing a closed loop. The closed loop includes the mandrel and a heat exchanger through which a coolant flows.

20 Claims, 4 Drawing Sheets

(56) References Cited

U.S. PATENT DOCUMENTS

| | | | | |
|---|---|---|---|---|
| 4,707,225 | A | 11/1987 | Schuler et al. | |
| 5,109,589 | A | 5/1992 | Cramer et al. | |
| 5,249,358 | A | 10/1993 | Tousignant et al. | |
| 5,317,805 | A | 6/1994 | Hoopman et al. | |
| 5,389,227 | A | 2/1995 | Matyi et al. | |
| 5,516,411 | A | 5/1996 | Kotowski et al. | |
| 5,728,284 | A | 3/1998 | Oyama | |
| 6,004,447 | A | 12/1999 | Bischoping et al. | |
| 6,007,692 | A | 12/1999 | Herbert et al. | |
| 6,112,804 | A | 9/2000 | Sachs et al. | |
| 6,602,053 | B2 | 8/2003 | Subramanian et al. | |
| 7,674,361 | B2 | 3/2010 | Cohen | |
| 8,061,032 | B2 | 11/2011 | Banham et al. | |
| 8,257,573 | B1 | 9/2012 | Cohen | |
| 9,528,776 | B1 | 12/2016 | Roper et al. | |
| 9,752,247 | B2 | 9/2017 | Cohen | |
| 2008/0179189 | A1* | 7/2008 | Szokolay | C25D 1/00 205/70 |
| 2008/0254162 | A1* | 10/2008 | Iimura | C25D 1/10 205/70 |
| 2009/0306692 | A1* | 12/2009 | Barrington | A61B 17/3203 156/150 |
| 2014/0272458 | A1 | 9/2014 | Ruan et al. | |
| 2016/0145755 | A1 | 5/2016 | Cook | |
| 2016/0313073 | A1 | 10/2016 | Larsson | |
| 2017/0253982 | A1 | 9/2017 | Kimble et al. | |
| 2017/0274583 | A1 | 9/2017 | Vernon | |

FOREIGN PATENT DOCUMENTS

| | | | |
|---|---|---|---|
| EP | 0049192 | B1 | 5/1987 |
| FR | 2092478 | A5 | 1/1972 |
| GB | 1542939 | A | 3/1979 |
| GB | 2194552 | A | 3/1988 |
| JP | 2595647 | B2 | 4/1997 |
| JP | 2014219048 | A | 11/2014 |

* cited by examiner

MANDREL FOR ELECTROFORMING

CROSS REFERENCE TO RELATED APPLICATIONS

This application claims priority to U.S. patent application Ser. No. 16/015,345, filed Jun. 22, 2018, currently allowed, which claims priority to and the benefit of U.S. Provisional Patent Application No. 62/577,409, filed Oct. 26, 2017, both of which are incorporated herein by reference in their entirety.

BACKGROUND OF THE INVENTION

An aircraft engine includes thin-walled ducts and other fluid delivery components to transfer cooling air, fuel, and other fluids throughout the engine. Current components include complex assemblies made from numerous individually formed and cut pieces that are welded or brazed together. The closed channel shape of these fluid ducting components requires tooling mandrels that are removable from the ducting component upon completion of the electroforming process.

BRIEF DESCRIPTION OF THE INVENTION

In one aspect, the present disclosure relates to a mandrel for an electroforming process, the mandrel comprising a body defined by a reclaimable material, and a cooling core within the body through which a coolant can flow.

In another aspect, the present disclosure relates to an electroforming system for forming a metallic component with an electroforming process, the electroforming system comprising an electrodeposition bath within a bath tank, a circuit including an anode and a cathode in the form of a mandrel and made from a reclaimable material, with the anode and cathode provided in the bath tank, and a coolant circuit including a heat exchanger, a cooling core formed within the mandrel, and a coolant tube fluidly coupling the heat exchanger with the cooling core through which a coolant can flow.

In yet another aspect, the present disclosure relates to a method for producing a metallic component with a mandrel in an electroforming process, the method comprising placing the mandrel in an electrodeposition bath, and flowing a coolant through a cooling core within the mandrel to actively cool the mandrel.

DETAILED DESCRIPTION OF THE EMBODIMENTS

Figure 1:
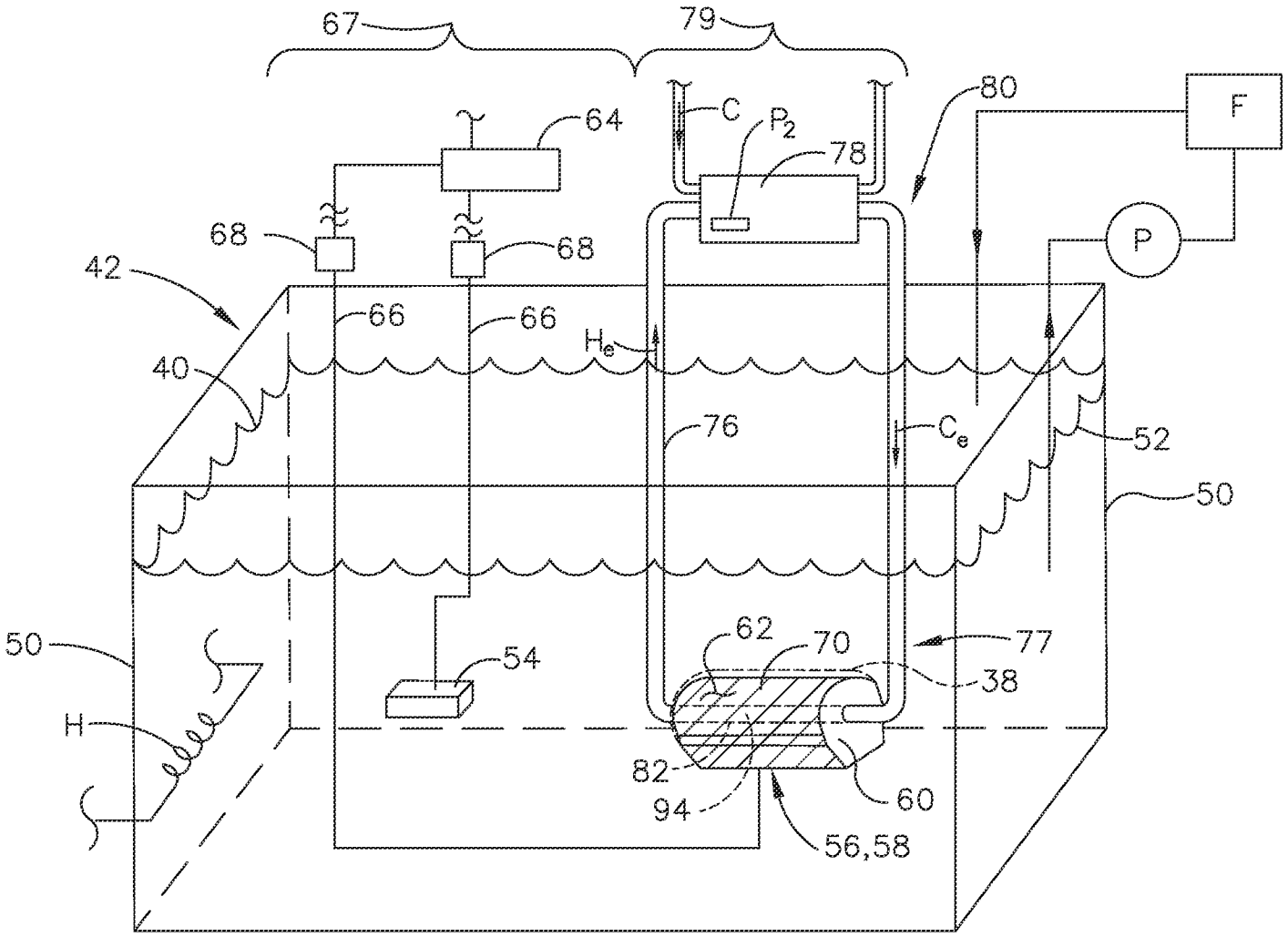
FIG. 1 is a schematic illustration of an electrodeposition bath with a mandrel.

The present disclosure relates to a mandrel used in electrodeposition having an actively cooled internal core. For purposes of illustration, the aspects of the disclosure discussed herein will be described with a mandrel used during an electroforming process. It will be understood, however, that the disclosure as discussed herein is not so limited and may have general applicability within forms utilized for electroforming processes and cooling in tool dies.

All directional references (e.g., radial, upper, lower, upward, downward, left, right, lateral, front, back, top, bottom, above, below, vertical, horizontal, clockwise, counterclockwise) are only used for identification purposes to aid the reader's understanding of the disclosure, and do not create limitations, particularly as to the position, orientation, or use thereof. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order, and relative sizes reflected in the drawings attached hereto can vary.

An electroforming process for forming a metallic component 38 (shown in dashed line) is illustrated by way of an electrodeposition bath 40 in FIG. 1. An exemplary bath tank 50 carries a conductive electrolytic fluid solution 52. The electrolytic fluid solution 52, in one non-limiting example, can include aluminum alloy carrying alloying metal ions. In one alternative, non-limiting example, the electrolytic fluid solution 52 can include a nickel alloy carrying alloying metal ions.

An anode 54 spaced from a cathode 56 is provided in the bath tank 50. The anode 54 can be a sacrificial anode or an inert anode. While one anode 54 is shown, it should be understood that the bath tank 50 can include any number of anodes 54 as desired. The cathode 56 can be a mandrel 58 coated in an electrically conductive material 62, including, by way of non-limiting examples, copper, silver, or nickel. The mandrel 58 defines a body 60 formed from, by way of non-limiting example, structural wax and including a cooling core 82. The body can be made of a reclaimable material, such as the structural wax, where a reclaimable material is one that can be collected after an electroforming process and reused as another body in another electroforming process. For example, the structural wax can be melted from the electroformed component at heightened temperatures to reclaim the material forming the body 60 after the electroforming process. Suitable reclaimable materials can include waxes, plastics, polymer foams, metals, or deformable materials, which as those collectible via melting or leeching in non-limiting examples. Carbon fiber or graphene nanoparticles can be used to increase thermal and electrical conductivity of wax and polymer mandrels. The addition of these particles will increase the thermal performance and resistance of slumping or deformation of the composite material. It is further contemplated that a conductive spray or similar treatment can be provided to the mandrel 58 to facilitate formation of the cathode 56. This initial conductive layer is typically thin, with significant variation in thickness over large surface areas. For larger mandrels with complex shapes, this variation will affect early-stage current density distribution across the mandrel surface. Strategic placement of multiple electrical contact locations to the cathodic surface is critical to reduce electrical potential differences. This condition is removed by use of an electrically conductive mandrel that is in continuous, uniformly distributed electrical contact with an electrically conductive coolant core tube with end electrical isolators or couplers. In addition, while illustrated as one cathode 56, it should be appreciated that one or more cathodes are contemplated for use in the bath tank 50.

A controller 64, which can include a power supply, can be electrically coupled to the anode 54 and the cathode 56 by electrical conduits 66 to form a circuit 67 via the electrolytic fluid solution 52. Optionally, a switch 68 or sub-controller can be included along the electrical conduits 66, and can be positioned between the controller 64 and the anodes 54 and cathode 56. During operation, a current can be supplied from the anode 54 to the cathode 56 via the electrolytic fluid solution 52 to electroform a monolithic metallic component 38 at the mandrel 58. During supply of the current, the metal, in this example aluminum, iron, cobalt, or nickel, from the electrolytic fluid solution 52 forms a metallic layer 70 over the mandrel 58.

By way of non-limiting example in an exemplary electroforming process, a pump (P) and filter (F) are utilized to filter and chemically maintain the electrolytic fluid solution 52 at a particular ion concentration, or to remove any foreign matter. The filter (F) can include, by way of non-limiting example, a chemical filtering media. A heater (H) is provided to regulate a temperature of the electrodeposition bath 40. In non-limiting examples, the heater (H) can be disposed within the bath tank 50 or proximate the bath tank 50 exterior to the bath tank 50. Alternatively, the heater (H) can be in fluid communication with the pump (P) to heat the electrolytic fluid solution 52 as it is pumped by the pump (P).

The temperature of the electrodeposition bath 40 is directly related to the level of residual internal stresses and grain size of the deposited material forming the metallic layer 70 and usually ranges from 50° C. to 70° C. (125° F. to 160° F.). Therefore, it can be desirable to utilize higher temperature ranges to tailor the residual internal stresses of the deposited material. However, at higher temperatures, a gradual softening of the body 60 of the mandrel 58 can occur, which can result in deformation of the structural wax or the body, which can lead to deformation of the electroformed component or uneven deposition. The softening or deflection temperature for structural wax is about 100° C. (220° F.). Therefore, even a small increase in temperature of 30° C. or more can result in deformation.

A system 42 including a coolant tube 76, a heat exchanger 78, and the mandrel 58 can compensate for this softening by locally cooling the body 60. The coolant tube 76 runs through the mandrel 58 and through the heat exchanger 78 to form a cooling circuit 79 having a closed loop 80 fluidly connected to the cooling core 82 within the mandrel 58. A coolant (Ce), or cool electrolytic fluid, relative to a bath temperature, flows through the closed loop 80 after being cooled by the external heat exchanger 78 and recirculated with a separate pump (P2). A cooling fluid (C), such as cold water, for example, is run through the heat exchanger 78 to cool a warm electrolytic fluid (He) after it has run through the mandrel 58. The mandrel 58 can therefore be actively cooled during the electroforming process by the system 42. After completion of the electroforming process, the body 60 can be reclaimed from the electroformed component, such as through heating and melting of the body 60 at heightened temperatures, to reclaim the structural wax material. In this way, material waste is reduced.

The coolant tube 76 includes exterior components 77 that are in contact with the electrolytic fluid solution 52. Such exterior components 77 or other exterior surfaces should be a thermally non-conductive material, by way of non-limiting example polyvinyl chloride (PVC). Similarly, a material such as PVC is not electrically conductive and does not collect metal ions from the electrolytic fluid solution 52, and no electrodeposition occurs along the coolant tube 76. Therefore, a low thermal conductivity of plastic PVC can serve as a thermal insulation between a coolant (Ce) within the coolant tube 76 and the warmer bath 40 of electrolytic fluid solution 52.

In one example, the coolant (Ce) in closed loop 80 can be a cooled electrolyte formed from the same solution as the electrolytic fluid solution 52 so that in the event leaking occurs from the closed loop 80, the main electrodeposition bath 40 remains contaminate free or does not result in a decrease in overall metal ion concentration. While the closed loop 80 is separate from the electrodeposition bath 40, a different coolant fluid type solution than that of the electrolytic fluid solution 52 can be considered for the coolant (Ce). However, where the goal is to remove possible cross-contamination with the bath chemistry, a coolant similar to or identical to the electrolytic fluid solution 52 can be utilized. More specifically, the chemical balance of the bath is critical to the electrodeposition process as well as the resulting material properties, grain size and residual stress.

Figure 2:
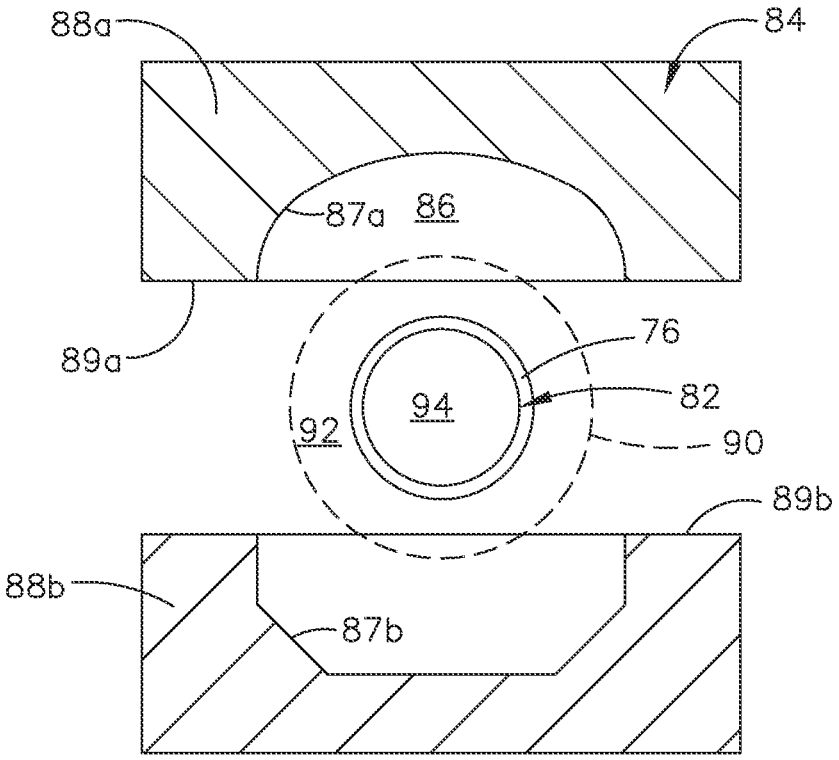
FIG. 2 is a cross-sectional view of a tool die in an open position and a coolant tube for forming the mandrel from FIG. 1.

FIG. 2 is an exemplary cross-section of a tooling die 84, shown in an open position, defining a cavity 86 shaped to form of the metallic component 38 discussed in FIG. 1, as the exemplary fluid carrying duct component. The tooling die 84 includes a tooling die top section 88*a* and a tooling die bottom section 88*b* each having confronting faces 89*a*, 89*b*. The tooling die top section 88*a* includes a rounded top portion 87*a* defining the shape of the metallic component 38. The tooling die bottom section 88*b* includes, a rectilinear bottom portion 87*b* including opposite facing slanted walls for the metallic component 38.

The coolant tube 76 can be provided between the tooling die top section 88*a* and the tooling die bottom section 88*b*. While illustrated as a circular tube, the coolant tube 76 can be any shape including oval, rectangular, or square, and is not limited by the illustration. It is further contemplated that the coolant tube 76 can include annular radial fins 90 to define at least a portion of the cooling core 82. The annular radial fins 90 can be added to the coolant tube 76 to increase a cooled concentric region 92 via heat transfer extending from the coolant tube 76.

Figure 3:
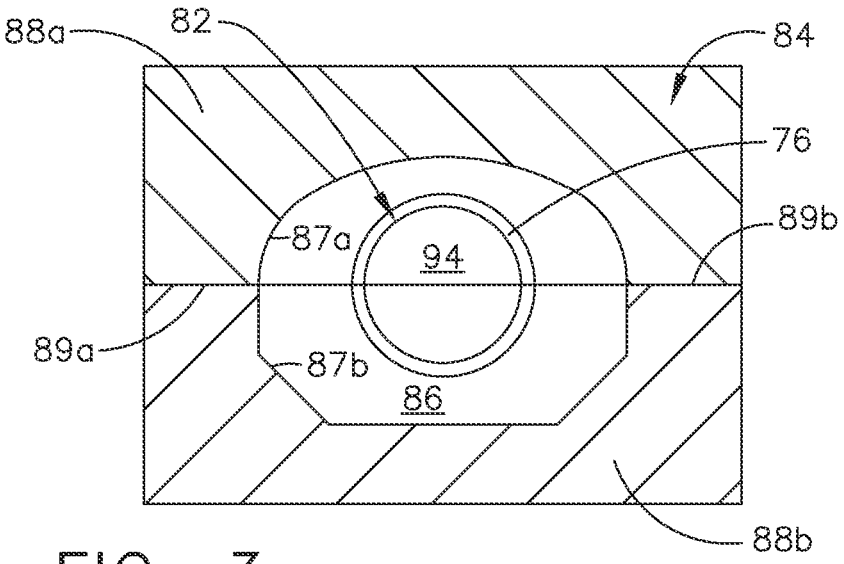
FIG. 3 is a cross-sectional view of the tool die of FIG. 2 in a closed position surrounding the coolant tube.

Turning to FIG. 3, the tooling die 84 has been closed into a closed position, with the tooling die top section 88*a* abutting the tooling die bottom section 88*b* at the opposing confronting faces 89*a*, 89*b*. The cavity 86 defines a wax mold cavity formed around the coolant tube 76.

Figure 4:
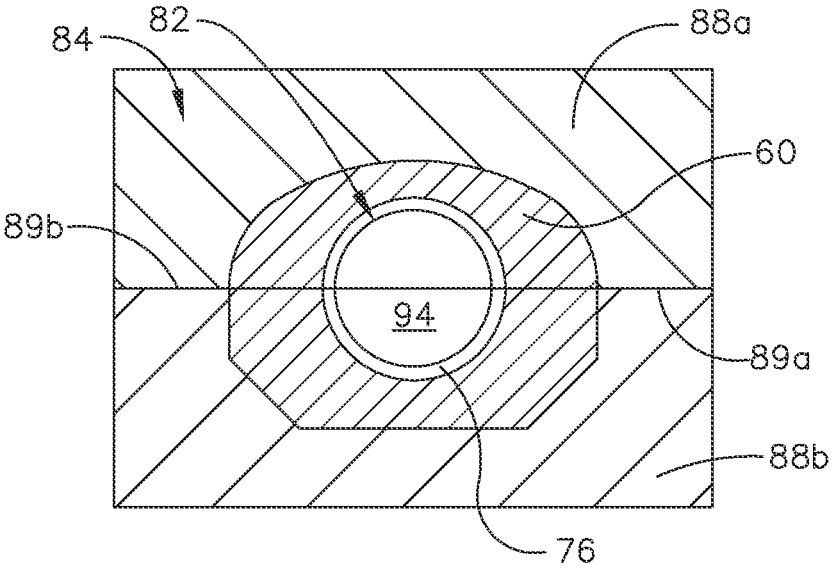
FIG. 4 is a cross-sectional view of the tool die of FIG. 3 in the closed position with a structural wax provided around the coolant tube.

Referring now to FIG. 4, the cavity 86 of the tooling die 84 is filled with liquid structural wax, for example, to define the body 60. The liquid structural wax is cooled to form the mandrel 58.

Figure 5:
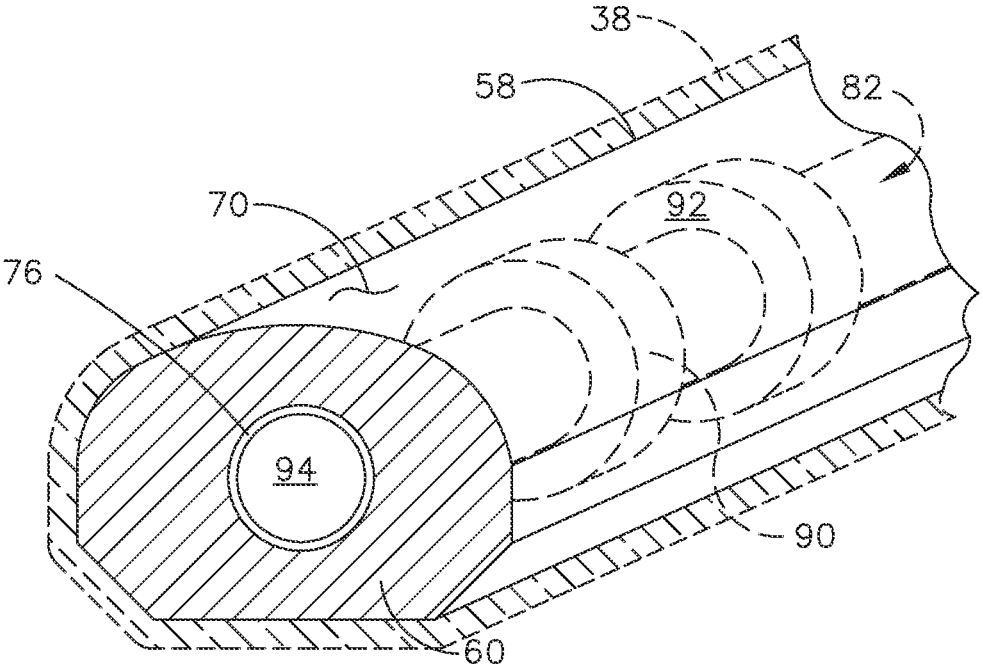
FIG. 5 is a partial isometric view of the mandrel of FIG. 1 with the coolant tube illustrated in dashed line.

FIG. 5 is an isometric view of the mandrel 58 and the metallic component 38, having the mandrel 58 and the metallic component 38 partially cut away to show the coolant tube 76 with exemplary annular radial fins 90 (both shown in dashed line). The coolant tube 76 forms a cooling channel 94 within the mandrel 58 that can define at least a portion of the cooling core 82. While shown as only a single cooling channel 94, it is contemplated that the cooling core 82 can include multiple cooling channels 94. It is further contemplated that the coolant tube 76 can be used to form the cooling core 82 during formation of the body 60, and can be removed before the electroforming process. A complex mandrel, by way of non-limiting example, with multiple bends and elbows can have a continuous segmented coolant tube 76 with multiple bellowed flex-joints to assist in removal. The cooling core 82 can further include the annular radial fins 90, as discussed herein, to cool the expanded concentric region 92. The annular radial fins 90 can provide for both increased local cooling as well as increased local structural rigidity. Finally, prior to electroforming or electro deposition, the mandrel 58 can be coated or treated with a metalized cathode surface, such as the metallic layer 70 of FIG. 1, to form a cathode surface in the electroforming process.

Figure 6:
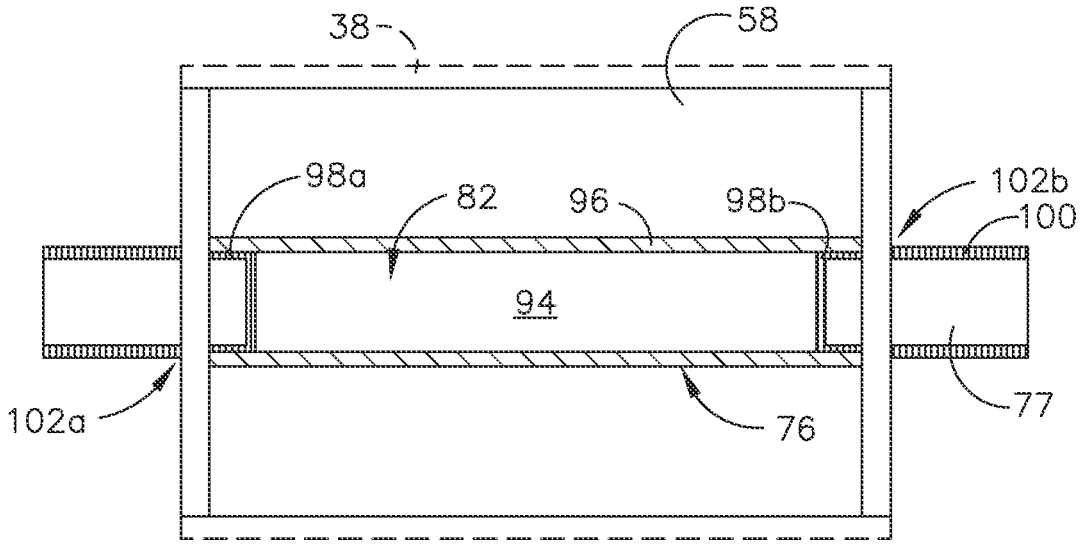
FIG. 6 is a cross-sectional view of the mandrel of FIG. 1 including fittings according to an aspect of the disclosure discussed herein.

Turning to FIG. 6, a cross-section of the mandrel 58 illustrates the coolant tube 76 passing through the mandrel 58 to define the cooling channel 94. In one non-limiting example, the coolant tube 76 within the mandrel 58 can be a conforming tube 96 having threaded ends 98*a*, 98*b*. The conforming tube 96 can be formed from an inert non-consumable material, such as a titanium conduit for example. A fitting 100, such as an inert non-consumable fitting, can be provided at each end 102*a*, 102*b* of the mandrel 58 to couple exterior components 77 of the coolant tube 76 to the cooling core 82. In one example, electrically conductive fittings can be threaded to threadably couple and electrically connect to the exterior components 77 of the coolant tube 76.

Figure 7:
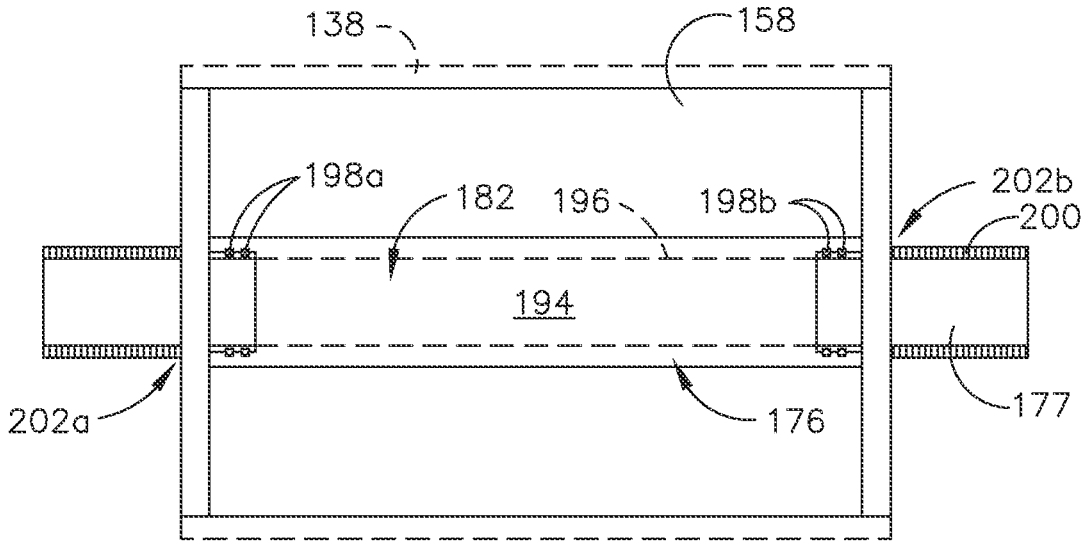
FIG. 7 is a cross-sectional view of the mandrel of FIG. 1 including fittings according to another aspect of the disclosure discussed herein.

Referring now to FIG. 7, an exemplary alternative mandrel 158, according to another aspect of the disclosure is shown. The mandrel 158 can be substantially similar to the mandrel 58 of FIG. 6. Therefore, like parts will be identified with like numerals increased by a value of one hundred, with it being understood that the description of the like parts of the mandrel 58 applies to the mandrel 158 unless otherwise noted.

It is contemplated that at least a portion of a coolant tube 176 includes a removable portion 196. The removable portion 196 can be removed to form a tubeless cooling core 182 prior to the electroforming process to form at least one cooling channel 194. While shown as a single cooling channel 194, it is contemplated that the tubeless cooling core 182 can have multiple cooling channels 194. Such cooling channels 194 can be discrete and fluidly isolated within the mandrel 158, for example. In one non-limiting example, the removable portion 196 of the coolant tube 176 can be used for complex multi-bend ducts where removal of a solid, rigid tube is not possible after completion of the electroforming or electrodeposition process. In one non-limiting example, the removable portion 196 can be a water-soluble wax or plastic. A fitting 200 can be provided at either end 202*a*, 202*b* of the mandrel 158. The fittings 200 can include multiple electrically conductive o-ring seals 198*a*, 198*b*, such as three or more, for example, to fluidly seal and couple the exterior components 177 of the mandrel 158 to the tubeless cooling core 182.

A method for producing a metallic component 38 with a mandrel 58, 158 that is actively cooled during the electroforming process includes placing the mandrel 58, 158 in an electrodeposition bath 40 and flowing a coolant, such as the coolant (Ce) of FIG. 1, through a cooling core 82, 182 to actively cool the mandrel 58, 158 during the electroforming process. The method further includes flowing the coolant (Ce) through a heat exchanger 78. Actively cooling the cooling core 82, 182 along with the concentric region 92 keeps the body 60, formed from structural wax, at an overall temperature of below 100° C. (220° F.) and therefore resists deflection, deformation, or softening.

It is further contemplated that the method can include coating the mandrel 58, 158 with an electrically conductive material 62 to form a metallic layer 70. To complete the electroforming process the metallic layer 70 is cooled, the body 60 of structural wax forming the mandrel 58, 158 can be removed leaving behind the metallic component 38 as discussed herein. The structural wax forming the body 60 can be removed using heating or a leeching process after the electroforming process. The melting temperature for structural wax is about 120° C. (250° F.). The structural wax used to form the body 60 can then be melted after the electroforming process at temperatures of 120° C. or greater, and reused or poured into a tooling die to form another mandrel.

As described herein, electroforming components having thin walls or electroforming components for complex thin-walled fluid delivery implementations in an aircraft engine can significantly reduce manufacturing costs and increasing quality, having greater consistency, stress-resistance, and component lifetime. Inexpensive mandrels for electroformed components can be critical to controlling costs. The use of reclaimable materials, like structural high-temperature wax, that are easily removed from closed channel electrodeposited shapes can provide for reducing cost and increasing quality. Reclaimable low-cost mandrel tooling is beneficial for the overall economic value of electroformed components. Structural wax is a material solution that is also easy to remove, thereby reducing post-processing costs.

Additionally, the process as described herein increases the thermal and dimensional stability of the wax mandrel in the hot electrodeposition bath. External loads from gravity and buoyancy can distort long and slender components of the mandrel, in addition to increased bath temperatures. Dimensional distortions of the mandrel from the gravitational and buoyance body-force loads as well as impingement velocity forces are decreased or removed with the method described herein, particularly when electroforming on a wax mandrel that is more resistant to deformation than one that is not cooled. Implementing a core that is cooled with low temperature electrolyte increases the temperature insensitivity of the wax mandrel by maintaining the structural integrity of the wax mandrel during the electroforming process. The location and impinging force of hot fluid mixing jets on long unsupported components with small cross-sectional modulus also decreases. The mandrel described herein is removable and reusable creating a cost-effective solution for creating a stable temporary mandrel form and subsequent post-process removal.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new examples, whether or not the new examples are expressly described. Combinations or permutations of features described herein are covered by this disclosure. Many other possible embodiments and configurations in addition to that shown in the above figures are contemplated by the present disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electroforming system for forming a component with an electroforming process, the electroforming system comprising:

an electrodeposition bath within a bath tank at a first temperature;

an anode;

a cathode in the form of a mandrel made from a reclaimable material, the reclaimable material comprising a structural wax having a melting temperature; and a coolant circuit at least partially passing through the cathode to cool the cathode such that a temperature for the cathode remains below the melting temperature while the first temperature is greater than the melting temperature.

2. The electroforming system of claim 1 wherein the mandrel further includes a cooling core.

3. The electroforming system of claim 2 further comprising a heat exchanger coupled to the coolant circuit.

4. The electroforming system of claim 3 further comprising a coolant tube fluidly coupling the heat exchanger to the cooling core through the electrodeposition bath.

5. The electroforming system of claim 4 wherein the cooling core further comprises a cooling channel.

6. The electroforming system of claim 5 wherein the coolant tube fluidly couples the heat exchanger to the cooling channel.

7. The electroforming system of claim 6 wherein the coolant tube and cooling core form a closed loop.

8. The electroforming system of claim 2 wherein the cooling core is a tubeless cooling core.

9. The electroforming system of claim 1 wherein the mandrel is coated in an electrically conductive material to define the cathode.

10. The electroforming system of claim 2 wherein the cooling core further comprises a cooling channel.

11. The electroforming system of claim 10 wherein at least a portion of the cooling core is removable.

12. The electroforming system of claim 1, wherein the melting temperature is 100° C.

13. The electroforming system of claim 1, wherein the coolant is an electrolytic fluid solution.

14. A method for reclaiming a mandrel for producing a metallic component with an electroforming process, the method comprising:

placing the mandrel in an electrodeposition bath within a bath tank of an electroforming system, the electroforming system including an anode and cathode defined by the mandrel, the mandrel made from a structural wax having a melting temperature, the electrodeposition bath being at a first temperature greater than the melting temperature; and flowing a coolant through a cooling core within the mandrel to actively cool the mandrel to increase temperature insensitivity for the mandrel during the electroforming process.

15. The method of claim 14 further including maintaining the mandrel at a temperature below 100° C.

16. The method of claim 14 further comprising flowing the coolant through a heat exchanger.

17. The method of claim 14 further comprising coating the mandrel with an electrically conductive material.

18. The method of claim 17 further comprising electroforming a metallic layer on the electrically conductive material to form the metallic component.

19. The method of claim 18 further comprising removing the structural wax from the metallic component.

20. The method of claim 14, wherein flowing the coolant through the cooling core increases stability of the mandrel against distortions created in the metallic component from external loads and temperatures.

* * * * *